US009146013B2

(12) United States Patent
Bauer et al.

(10) Patent No.: US 9,146,013 B2
(45) Date of Patent: Sep. 29, 2015

(54) PROJECTION MODULE FOR A MOTOR VEHICLE

(71) Applicant: ZIZALA LICHTSYSTEME GMBH, Wieselburg (AT)

(72) Inventors: Friedrich Bauer, Bergland (AT); Dietmar Kieslinger, Vienna (AT); Andreas Moser, Haag (AT); Marcel Rauch, St. Leonhard i.P. (AT); Thomas Schlinger, Böheimkirchen (AT)

(73) Assignee: ZIZALA LICHTSYSTEME GMBH, Wieselburg (AT)

( * ) Notice: Subject to any disclaimer, the term of this patent is extended or adjusted under 35 U.S.C. 154(b) by 0 days.

(21) Appl. No.: 14/386,578

(22) PCT Filed: Mar. 20, 2013

(86) PCT No.: PCT/AT2013/050069

§ 371 (c)(1),
(2) Date: Sep. 19, 2014

(87) PCT Pub. No.: WO2013/138834

PCT Pub. Date: Sep. 26, 2013

(65) Prior Publication Data

US 2015/0023045 A1 Jan. 22, 2015

(30) Foreign Application Priority Data

Mar. 21, 2012 (AT) ..... A 50093/2012

(51) Int. Cl.
*F21S 8/10* (2006.01)
*F21W 101/10* (2006.01)
(Continued)

(52) U.S. Cl.
CPC ..... *F21S 48/1317* (2013.01); *F21S 48/11* (2013.01); *F21S 48/1159* (2013.01);
(Continued)

(58) Field of Classification Search
USPC ..... 362/516, 507, 538, 539
See application file for complete search history.

(56) References Cited

U.S. PATENT DOCUMENTS 6,123,440 A 9/2000 Albou
2003/0214815 A1* 11/2003 Ishida et al. ..... 362/516
(Continued)

FOREIGN PATENT DOCUMENTS

DE 19602978 A1 7/1997
DE 19853402 A1 6/1999
(Continued)

OTHER PUBLICATIONS

First Office Action for Austrian Priority Application No. 50093/2012 dated Jan. 25, 2013.
(Continued)

*Primary Examiner* — Laura Tso
(74) *Attorney, Agent, or Firm* — Sutherland Asbill & Brennan LLP

(57) ABSTRACT

The invention relates to a light module (1) for a motor vehicle, comprising at least one light source (1, 10, 11, 100, 110), at least one reflector (2, 20, 21, 200, 210, 2000), and at least one lens (3, 30, 31, 300, 310), wherein the light emitted by the light source (1, 10, 11, 100, 110) is formed into a light distribution by a reflecting surface (2*a*, 20*a*, 21*a*, 22*a*, 200*a*, 210*a*, 2000*a*) of the at least one reflector (2, 20, 21, 200, 210, 2000) and—when the light module (1) is fitted in a vehicle—is projected via the at least one lens (3, 30, 31, 300, 310) into an area in front of the vehicle. According to the invention, the reflecting surface (2*a*, 20*a*, 21*a*, 22*a*, 200*a*, 210*a*, 2000*a*) of the at least one reflector (2, 20, 21, 200, 210, 2000) is formed in such a way that a first focal point (F1) of the reflector (2, 20, 21, 200, 210, 2000) is located between the reflecting surface (2*a*, 20*a*, 21*a*, 22*a*, 200*a*, 210*a*, 2000*a*) and the at least one lens (3, 30, 31, 300, 310), and a second focal point (F2) is located on the side of the reflector (2, 20, 21, 200, 210, 2000) facing away from the lens (3, 30, 31, 300, 310), wherein the reflecting surface (2*a*, 20*a*, 21*a*, 22*a*, 200*a*, 210*a*, 2000*a*) of the reflector (2, 20, 21, 200, 210, 2000) is designed in such a way that the light pattern generated comprises at least one light-dark line.

15 Claims, 8 Drawing Sheets

(51) Int. Cl.
*F21Y 103/00* (2006.01)
*F21Y 105/00* (2006.01)

(52) U.S. Cl.
CPC ..... *F21S 48/125* (2013.01); *F21S 48/1266* (2013.01); *F21S 48/1335* (2013.01); *F21S 48/1382* (2013.01); *F21W 2101/10* (2013.01); *F21Y 2103/00* (2013.01); *F21Y 2105/00* (2013.01)

(56) References Cited

U.S. PATENT DOCUMENTS

| | | | | |
|---|---|---|---|---|
| 2005/0207162 | A1* | 9/2005 | Komatsu | 362/296 |
| 2007/0279924 | A1* | 12/2007 | Yagi | 362/509 |
| 2010/0046243 | A1* | 2/2010 | Yatsuda | 362/538 |
| 2011/0222304 | A1* | 9/2011 | Tatsukawa | 362/518 |
| 2013/0033864 | A1* | 2/2013 | Spinger et al. | 362/235 |

FOREIGN PATENT DOCUMENTS

| | | | |
|---|---|---|---|
| DE | 102005012649 | A1 | 10/2005 |
| DE | 102009037698 | A1 | 3/2010 |
| EP | 1225388 | A2 | 7/2002 |
| EP | 1357333 | A2 | 10/2003 |
| JP | 2006156047 | A | 6/2006 |
| JP | 2007287521 | A | 11/2007 |
| JP | 2007324003 | A | 12/2007 |
| WO | 2011132111 | A2 | 10/2011 |

OTHER PUBLICATIONS

International Search Report for PCT/AT2013/050069 dated Jul. 18, 2013.
Written Opinion for PCT/AT2013/050069 dated Jul. 4, 2014.

* cited by examiner

PROJECTION MODULE FOR A MOTOR VEHICLE

BRIEF SUMMARY OF THE INVENTION

The invention relates to a light module for a motor vehicle comprising:

at least one light source;

at least one reflector;

at least one lens;

wherein the light emitted by the light source is formed into a light distribution by a reflecting surface of the at least one reflector and—when the light module is fitted in a vehicle—is projected via the at least one lens into an area in front of the vehicle.

The invention also relates to a vehicle headlight comprising at least one such light module.

The radiation characteristics desired for front headlights of motor vehicles can be produced by means of different technical approaches. Here, the following are known a) pure reflector systems with paraboloid and free-form reflectors and b) projection systems, in which a converging lens projects the image of a beam stop onto the area in front of the motor vehicle, that is to say generally onto the road. The beam stop is illuminated here by a unit arranged therebehind, which, besides a light source, usually also has a primary optics in the form of a reflector/mirror, light guide, etc.

Both approaches have specific advantages and disadvantages. A disadvantage common to both approaches is the fact that both systems require a relatively large amount of installation space. With approach a), in particular with the free-form reflectors nowadays used almost exclusively, a large amount of installation space is required in the direction transverse to the optical axis, whereas with projection systems according to approach b) a large amount of installation space is required in the direction of the optical axis.

The object of the invention is to create a compact light module for a motor vehicle without impairing the lighting properties.

This object is achieved with a light module of the type mentioned in the introduction or with a vehicle headlight comprising at least one such light module in that, in accordance with the invention, the reflecting surface of the at least one reflector is formed in such a way that a first focal point of the reflector is located between the reflecting surface and the at least one lens and a second focal point is located on the side of the reflector facing away from the lens, wherein the reflecting surface of the reflector is designed in such a way that the light pattern generated comprises at least one light-dark line.

The light module according to the invention is a projection system in which light from a light source is concentrated through a primary optics in the form of a reflector and is guided onto a (projection) lens, which projects the desired light pattern onto an area in front of the light module or vehicle.

In contrast to a conventional structure, in which a real intermediate image is generated by the reflector, in the case of the present invention the reflector generates a virtual intermediate image of the light source, which is then projected through the lens in the form of a converging lens into the area in front of the light module or vehicle. To this end, the reflector is formed as a hyperbolic reflector or has substantially the behaviour of a hyperbolic reflector.

Here, in a first variant of the invention, the reflector is formed substantially as a reflector partial shell, for example as a reflector half shell, in order to form the at least one light-dark line in the light pattern, wherein light from an area of the delimiting edge of the reflector partial shell forms the light distribution at the light-dark line in the light pattern.

In this variant, the edge of the reflector (the "trimmed edge" so to speak of a full reflector) acts as a porthole between the virtual object and the lens. Parts of a reflector located close to the lens behave approximately as an aperture stop and therefore offer little design freedom in view of the light pattern, since the image detail remains unchanged with a change of the aperture, that is to say the light exposure is not changed or is only changed insignificantly.

Portions of the reflector that are further away from the lens, however, have the character of a field of view stop to a greater extent; a change to these areas also changes the projected image detail, and these regions can be used accordingly to form the light pattern.

By way of example, with a reflector described in greater detail further below, which is formed as a half shell and is opened downwardly, the upper regions of the reflector can be trimmed in order to reduce the intensity of the light distribution in the area arranged to the front of the vehicle, whereas the form of the light distribution at the LD line can be varied by trimming the lower edge.

In a specific embodiment of the invention, the reflector partial shell is open downwardly in the fitted position of the light module, such that a light-dark line arranged at the top in the light pattern is produced.

Further, the delimiting edge of the reflector partial shell may run substantially above a plane in which the at least one light source is arranged.

The light-dark line in the light pattern, for example as is required of a dipped beam distribution conforming to legal requirements, can thus be lowered by 0.57° (ECE regulation) or 0.4° (SAE regulation).

Further, the delimiting edge can be curved toward the front, upwardly toward the front reflector opening.

Here, curved "upwardly" primarily means that the delimiting edge is curved away from the plane in which the light source is arranged. By way of example, the light source may be inclined with respect to a horizontal plane and the delimiting edge in principle runs parallel to the inclined light source. Here, the effect may be produced that the light distribution is curved upwardly in an outer edge region of the light distribution, such that light reaches an area above the legally permissible areas.

Due to the upwardly curved course of the delimiting edge, this effect can be counteracted, such that no light reaches inadmissible areas above the LD boundary.

In order to increase the sharpness of the projection of the light-dark boundary of the reflector, the at least one light source may have an elongate configuration and the light source may be arranged relative to the reflector in such a way that, in the light pattern, the filament images generated by the reflecting surface of the reflector are substantially parallel to the light-dark boundary in the light pattern, since the extent of the blur is directly proportional to the size of the filament image, measured transversely to the light-dark boundary.

The longitudinal axis of the light source thus runs substantially parallel to the light-dark boundary to be generated, wherein an inclination of a few degrees relative to the light-dark boundary may be quite sensible from an optical viewpoint.

Such a light source thus has a much longer longitudinal than transverse extension, for example such a light source is a light source formed from a number of light-emitting diodes, for example in a (1×n) arrangement, in which n LEDs are arranged in a row, that is to say the light source has a width of one LED and a length of n LEDs. Other examples of such elongate light sources are the arc of an Xe burner or the filament of a discharge lamp.

In order to increase the sharpness of the projection of the light-dark boundary of the reflector functioning as a real stop, the at least one light source may also have a planar light exit surface, wherein the light exit surface faces the reflecting surface of the reflector.

Here, the light-emitting surface of the at least one light source is preferably substantially planar, wherein the delimiting edge of the reflector forming the light-dark boundary is arranged in an area in which the light-emitting surface of the at least one light source is perspectively shortened.

This last measure can be implemented independently or together with the above-mentioned elongate configuration of the light source.

In the above-described embodiment, the reflector generates one or more light-dark boundaries in the light pattern since the reflector functions as a real stop, that is to say the delimiting edge(s) of the reflector is/are projected in the light pattern as light-dark boundaries (or areas of maximum brightness).

In accordance with another variant, the reflecting surface of the reflector is formed in such a way that light from the at least one light source reflected along at least one defined curve on the reflecting surface is projected in the light pattern as an area with maximum brightness.

The generation of one or more light-dark boundaries with a reflector is based here on the effect of what is known as caustics, and therefore one or more light-dark boundaries formed arbitrarily in principle can be generated without use of stops. The at least one defined curve on the reflecting surface is projected in the light pattern as a caustic line, that is to say as a line with maximum brightness, and the brightness reduces on one side (for example beneath this line) and no light or hardly any light is projected on the other side (that is say for example above the line).

Furthermore, the reflecting surface of the reflector is formed in such a way that light from both sides of the at least one defined curve on the reflecting surface is projected in the light pattern on a side of the area with maximum brightness, adjacently to said area.

With a substantially horizontal light-dark boundary (caustic line), the light from both reflector areas is accordingly projected beneath the caustic line and generates the light distribution below the LD line.

Such a reflector according to the invention can be varied in a versatile manner, for example by making it smaller in terms of the installation space.

By way of example, starting from a reflector which generates a defined light distribution with defined brightness distribution, this reflector can be trimmed substantially parallel to the defined curve on the reflecting surface, which is projected in the light pattern as an area with maximum brightness, on at least one side of the defined curve.

Due to this trimming substantially parallel to the defined curve, the form of the light pattern is substantially obtained, wherein the light pattern becomes darker.

In accordance with another variant, starting from a reflector which generates a defined light distribution with defined brightness distribution, this reflector is trimmed substantially normal to the defined curve on the reflecting surface, which is projected in the light pattern as an area with maximum brightness.

Due to this trimming substantially normal to the defined curve, the light pattern becomes smaller, however the brightness in the areas still remaining in the light pattern is substantially unchanged.

Of course, a reflector formed as a real stop with one or more defined curves, which generate a caustic line, can also be provided, whereby there are a large number of design possibilities in view of the generation of the light pattern.

In particular, a light module according to the invention has the advantage that the entire installation depth of the light module is no longer determined by the sum of the focal lengths of the primary optics (reflector) and secondary optics (lens), but by the difference between the two focal lengths and can therefore be severely reduced theoretically. Although there are practical limitations here (finite size of the light source, manufacturing tolerances, etc.) and the reduction of the installation depth is therefore subject to limits, the installation volume can be much smaller in the case of a light module or headlight according to the invention than in the case of conventional known systems.

Since only the difference of the focal widths of primary and secondary optics is directly involved in the overall size, the focal length per se is a virtually free design parameter, which can be used in order to improve the light pattern.

With a light module according to the invention, the total refractive power is divided among reflector and lens. Here, the cross section of the lens is comparable to a conventional projection system with real intermediate image and otherwise similar characteristic values, and therefore the required numerical aperture of the lens decreases. Since chromatic aberration occurs only in the case of refraction, but not in the case of reflection, an improvement of the colour fidelity can be achieved already, since some of the refractive power is taken over by the reflector.

Further, the lens may be formed as an achromatic lens, which may also be conducive to the correction of colour errors. In the case of conventional projection lenses with very large numerical aperture, it is not possible to form the lens as an achromatic lens.

BRIEF DESCRIPTION OF THE DRAWINGS

The invention will be explained in greater detail hereinafter on the basis of the drawing, in which

FIG. 1 schematically shows a light module 1 for a motor vehicle, comprising a light source 1, a reflector 2 and a lens 3.

DETAILED DESCRIPTION OF THE INVENTION

The reflecting surface 2*a* of the reflector 2 is formed here in such a way that a first focal point F1 of the reflector 2 is located between the reflecting surface 2*a* and the lens 3. A second focal point F2 is located on the side of the reflector 2 facing away from the lens 3, that is to say behind the reflector.

The light emitted by the light source 1 is formed into a light distribution by the reflecting surface 2*a* of the reflector 2 and—when the light module 1 is fitted in a vehicle—is projected via the lens 3 into an area in front of the vehicle.

The light module 1 according to the invention (and also in all further shown modules and systems) is a projection system, in which light from a light source is concentrated through a primary optics in the form of a reflector and is guided onto a (projection) lens, which projects the desired light pattern onto an area in front of the light module or vehicle. In contrast to a conventional structure, in which a real intermediate image is generated by the reflector, in the present invention the reflector 2 generates a virtual intermediate image of the light source which comes to lie substantially in the rear focal point F2 of the reflector 2, and this intermediate image is then projected by the lens 3 in the form of a converging lens into the area in front of the light module or vehicle. To this end, the reflector is formed as a hyperbolic reflector or has substantially the behaviour of a hyperbolic reflector, and the focal point of the lens 3 is located substantially in the rear focal point F2 of the reflector 2.

Figure 1:
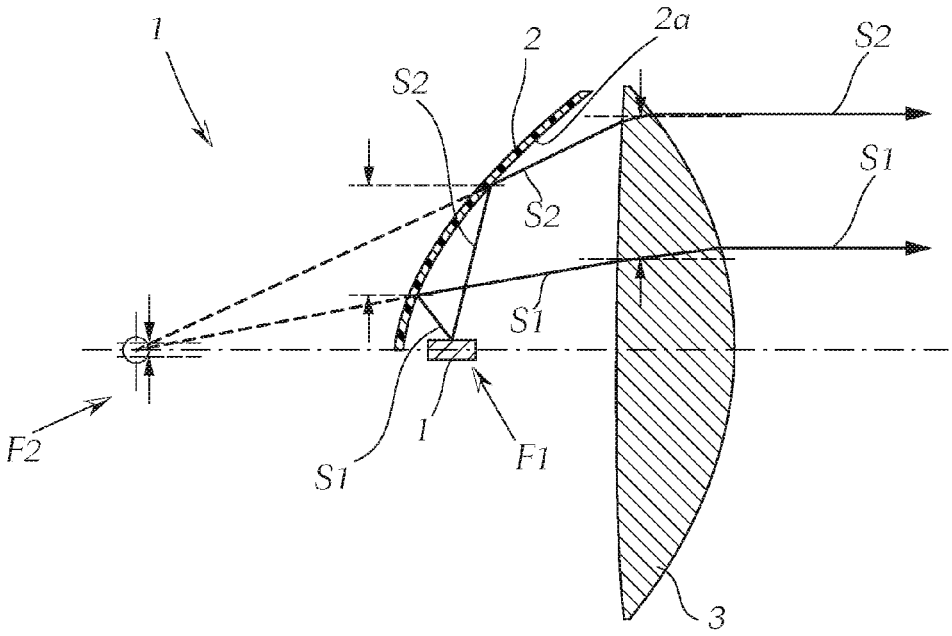
FIG. 1 shows a schematic illustration of a light module according to the invention.
Figure 2:
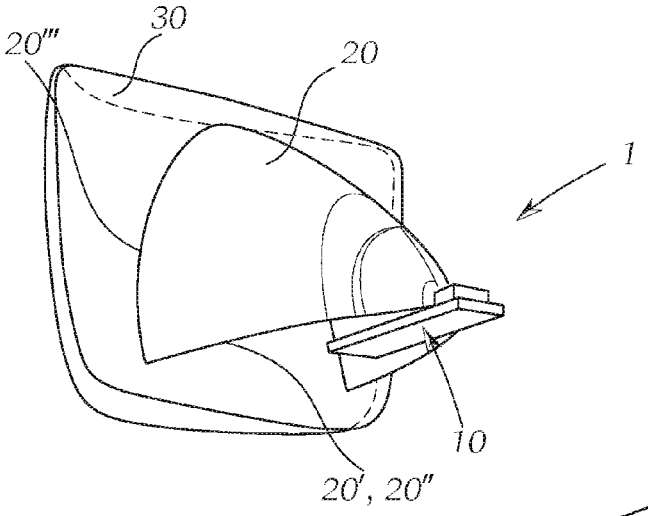
FIG. 2 shows a first variant of a light module according to the invention in a perspective view diagonally from below.
Figure 3:
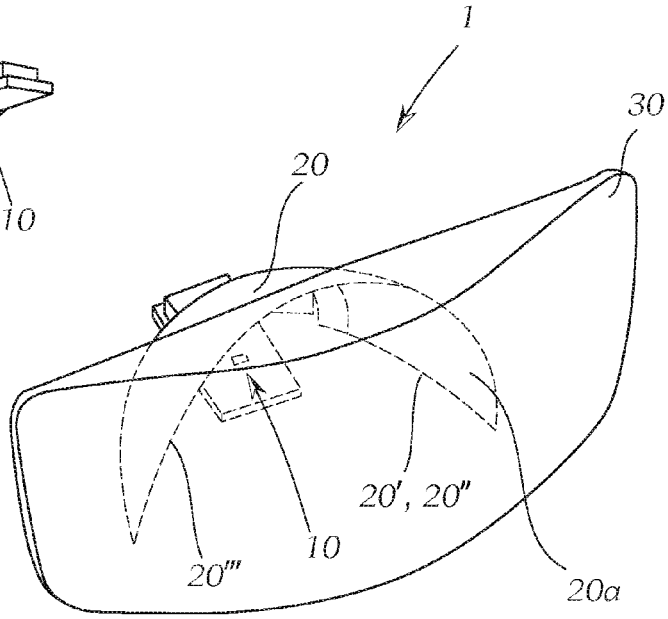
FIG. 3 shows the light module from FIG. 2 in a perspective view diagonally from above.

Under consideration of FIG. 1, the areas of the reflector 2 localised by arrows can thus be seen. If a reflector 2 illustrated in FIG. 1 is trimmed above the area marked by the upper arrow and below the area marked by the lower arrow, only the two beams S1, S2 indicated as limit beams and beams arranged therebetween will still be produced from the reflector 2 and projected by the lens 3.

With a present light module, a fundamental feature according to the invention is the fact that the reflecting surface of the reflector is formed in such a way that the generated light pattern has at least one light-dark line.

As can be clearly seen in FIG. 1, it is possible with a reflector 2, for example by trimming the reflector, to give the light distribution a desired form, in particular to provide the light distribution with at least one light-dark boundary, as is the case for example with dipped beam distributions or with partial daytime running light distributions.

The edge of the reflector (the "trimmed edge" so to speak of a full reflector) acts as a porthole between the virtual object and the lens. Parts of a reflector located close to the lens behave similarly to an aperture stop and therefore provide little design freedom in view of the light pattern, since the image detail remains unchanged with a change of the aperture, that is to say the light exposure is not changed or is only changed insignificantly.

Portions of the reflector that are further away from the lens, however, have the character of a field of view stop to a greater extent; a change to these areas also changes the projected image detail, and these areas can be used accordingly to form the light pattern.

By way of example, in the case of a reflector described on the basis of FIGS. 2 to 5, which is formed as a half shell and is open downwardly, the upper areas of the reflector are trimmed in order to reduce the intensity of the light distribution in the area arranged to the front of the vehicle, whereas the form of the light distribution at the LD line can be varied by trimming at the lower edge.

FIGS. 2 to 5 show a light module 1 comprising a light source 10, reflector 20 with reflecting surface 20*a*, and lens 30. Here, the sizes are purely schematic, and in particular the lens may be much smaller and for example is as large as the reflector.

The reflector 20 is formed as a partial shell, in particular as a half shell, and the light source 10 irradiates light into this half shell, at which the light is reflected on the reflecting surface 20*a*.

Figure 4:
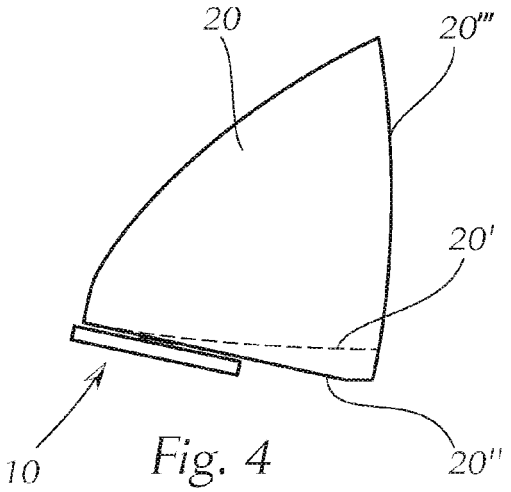
FIG. 4 shows the reflector including light source of a light module from FIG. 2 in a side view.
Figure 5:
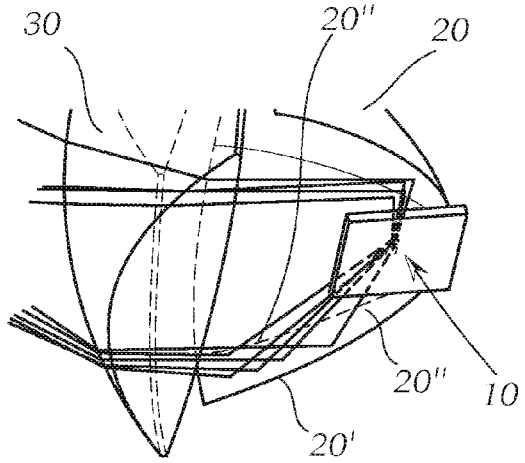
FIG. 5 shows the beam path with a reflector corresponding to FIG. 4.

The reflector half shell 20 is delimited downwardly by a delimiting edge 20', 20", as is shown in FIGS. 4 and 5. Light from the light source 10, which is reflected from an area around this delimiting edge 20', 20", is projected from the lens in the light pattern close to or at the light-dark boundary, that is to say the lower delimiting edge 20', 20" is projected in the light pattern as a light-dark boundary which delimits the light pattern upwardly.

Figure 6:
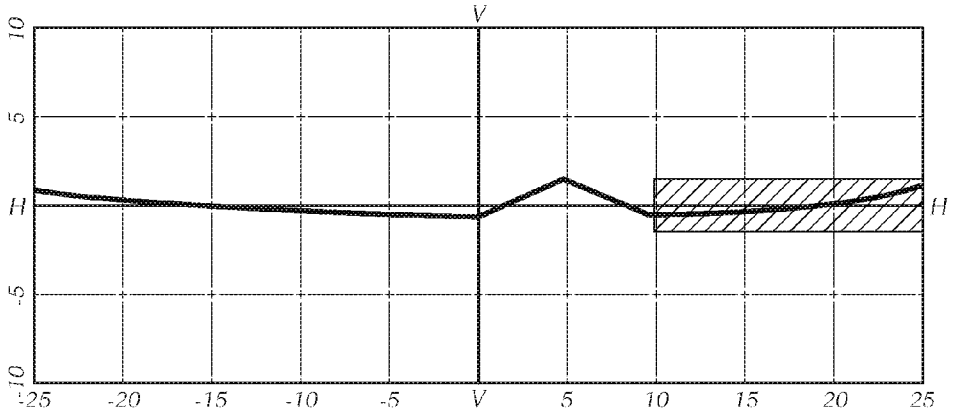
FIG. 6 shows a light distribution generated with a reflector from FIG. 4.
Figure 7:
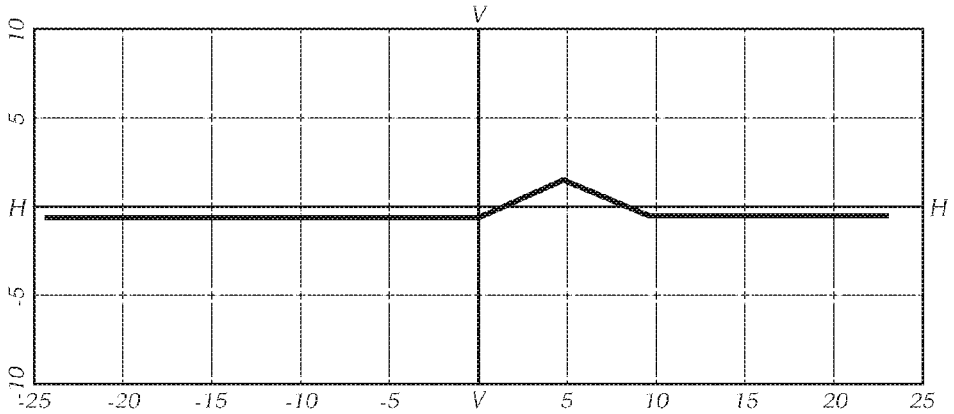
FIG. 7 shows a modified light distribution generated with a modified reflector from FIG. 4.

Since the delimiting edge 20', 20" is located in this example (following trimming thereof, as also described) in a horizontal plane, the light-dark boundary also substantially forms a horizontally running straight line, as can be clearly seen in FIGS. 6 and 7.

Light originating from areas of the reflecting surface 20*a* above the delimiting edge 20', 20" is projected in the light pattern into an area beneath the light-dark boundary and generates the light in front of the vehicle. To this end, the reflector is typically formed in such a way that the virtual images of the light source are not located exactly in the focal point of the lens, but slightly thereabove or to the side thereof. By "trimming"; that is to say varying/changing the front delimiting edge 20'", the form or illumination of the area in front of the vehicle can be influenced.

Furthermore, as shown, the delimiting edge 20', 20" of the reflector partial shell 20 can run substantially above a plane in which the light source 10 is located. In this way, the light-dark line in the light pattern, for example as is required of a dipped beam distribution conforming to legal requirements, can be lowered by 0.57° (ECE regulation) or 0.4° (SAE regulation), as is illustrated in FIGS. 6 and 7.

Here, the light source 10, as can be seen clearly in particular in FIG. 4, can be inclined slightly forwards, and therefore the plane in which the light source is located is inclined accordingly.

If the lower delimiting edge 20" of the reflector 20 runs substantially parallel to the (inclined) plane in which the light source 10 is located, as is shown in FIG. 4, a course of the light-dark boundary as illustrated in FIG. 6 is thus produced.

As can be clearly seen in FIG. 6, the effect may be produced here that the light distribution is curved upwardly in an outer edge region of the light distribution, such that light passes into an area above the legally permissible areas. This is due to the fact that, as illustrated schematically in FIG. 5, light from an area between the curves 20' and 20" is deflected upwardly above the lens and is thus projected above the permissible LD boundary.

If the reflector 20 is trimmed along the curve 20', such that the resultant lower delimiting edge is now formed by the edge 20', the legally compliant light pattern shown in FIG. 7 is thus produced without upwardly curved LD boundary in the outer area.

Figure 8:
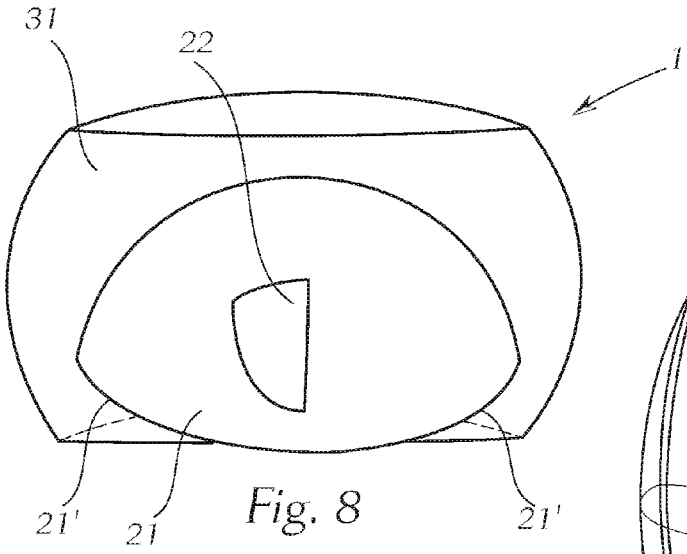
FIG. 8 shows a second variant of a reflector according to the invention in a view from behind.
Figure 9:
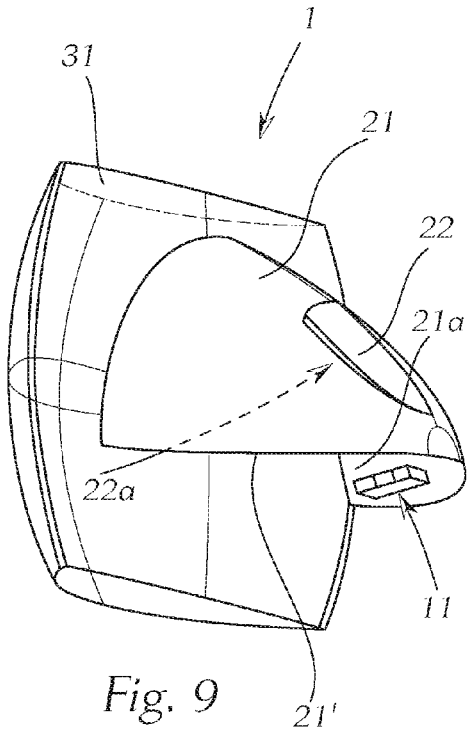
FIG. 9 shows the reflector from FIG. 8 in a perspective view diagonally from below, FIG. 10 schematically shows reflection points on a reflector surface.

The asymmetry part located at approximately 5° in FIGS. 6 and 7 is not formed by the edge 20', but is usually produced by a reflector segment (not illustrated in 2-5), such as a segment 22 as shown in FIGS. 8 and 9.

In order to increase the sharpness of the projection of the light-dark boundary of the reflector, the at least one light source may have an elongate configuration, and the light source may be arranged relative to the reflector in such a way that, in the light pattern, the filament images produced by the reflecting surface of the reflector are located substantially parallel to the light-dark boundary in the light pattern, since the spread of the blur is directly proportional to the size of a filament image, measured transversely to the light-dark boundary.

The longitudinal axis of the light source thus runs substantially parallel to the light-dark boundary to be produced, wherein an inclination of a few degrees with respect to the light-dark boundary may be quite sensible from an optical viewpoint.

Such a light source thus has a much longer longitudinal than transverse extension, for example the light source is a light source formed from a number of light-emitting diodes, for example in a (1×n) arrangement, in which n LEDs are arranged in a row, that is to say the light source has a width of one LED and a length of n LEDs. Other examples for such elongate light sources include the arc of an Xe burner or the filament of a discharge lamp.

In order to increase sharpness of the projection of the light-dark boundary of the reflector functioning as a real stop, the at least one light source may also have a planar light exit surface, wherein the light exit surface faces the reflecting surface of the reflector.

Here, the plane of the light source and the plane in which the lower delimiting edge of the reflector is located preferably run in a substantially parallel plane.

For example, the light-emitting surface of the light source may also preferably be substantially planar, wherein the delimiting edge of the reflector forming the light-dark boundary is arranged in an area in which the light-emitting surface of the at least one light source is perspectively shortened.

This last measure can be implemented independently or jointly with the above-mentioned elongate configuration of the light source.

With the above-described embodiment, the reflector generates one or more light-dark boundaries in the light pattern since the reflector functions as a real stop, that is to say the delimiting edge(s) of the reflector is/are projected in the light pattern as light-dark boundaries (or areas of maximum brightness).

FIGS. 8 and 9 show a light module 1 comprising a reflector 21, light source 11 and lens 31. The reflector 21 has a reflecting surface 21*a* and a lower delimiting edge 21' comparable to the embodiment described above on the basis of FIGS. 2-5.

A horizontal light-dark boundary is generated in the light pattern with this delimiting edge 21'. Areas of the reflector 21 located close to the lens are accordingly arranged far outwardly to the side in the light pattern and are accordingly lowered, such that the occurring blur of the LD line does not interfere in the light pattern.

The key parts in the light pattern closer to HV utilise the above-described perspective shortening of the light source, such that the light-dark line is projected there sufficiently sharply.

In a specific example, the hyperbolic reflector has a focal length of approximately 40 mm and the lens is an aspherical converging lens with a focal length of approximately 100 mm.

As can also be inferred from FIGS. 8 and 9, the reflector 21 has an additional reflector area 22 with reflecting surface 22*a*. This reflector area or this reflector segment 22 illuminates a central area directly around HV in the dipped beam distribution. Here, this reflector segment 22 or reflecting surface 22*a* thereof is designed in such a way that it generates what is known as a caustic.

Figure 10:
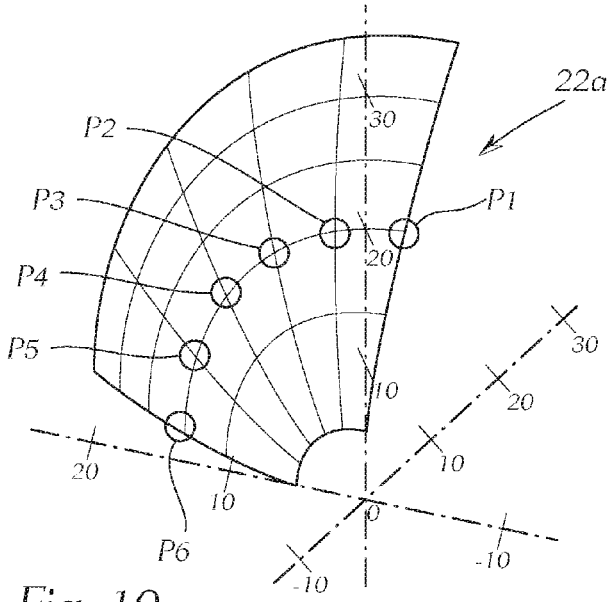
Figure 11:
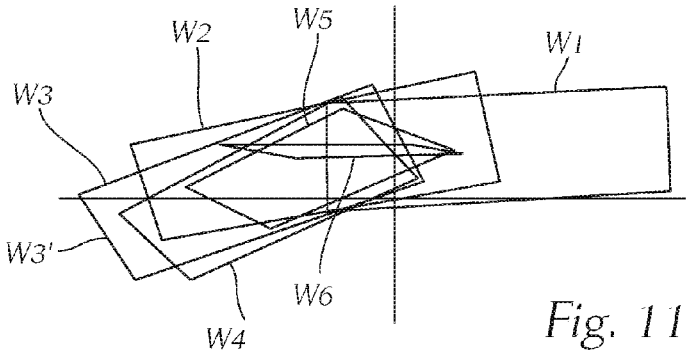
FIG. 11 shows projections generated via the reflection points of the reflector surface from FIG. 10.

For illustration, FIG. 10 schematically shows the reflecting surface 22*a*, on which a number of reflector locations P1, P2, P3, P4, P5, P6 are highlighted. FIG. 11 shows the filament images W1-W6 in the light pattern generated by theses reflector locations P1-P6. If the reflector is traversed along a line connecting the points P1-P6, the filament images W1, W2, W3 are for the moment then encountered with the corresponding points P1-P3. The point P3 constitutes an extreme position, that is to say a turning point for the filaments in the light pattern, because, as can be seen, passing further from P3 to P4 and then to P5 and P6, the filaments W4, W5, W6 migrate back again in the direction of the filament W1.

The filament image W3, via its outermost delimiting edge W3', thus contacts the caustic (see further below for more detailed explanations); the reflector 22 or the reflector surface 22*a* can be trimmed in the vicinity of the point P3 without changing the sharpness of the light-dark boundary.

If this process as described on the basis of FIGS. 10 and 11 is repeated for a number of lines on the reflector, the complete trim curve for the reflector 22 is ultimately obtained, said reflector then assuming the form as illustrated in FIGS. 8 and 9.

Figure 12:
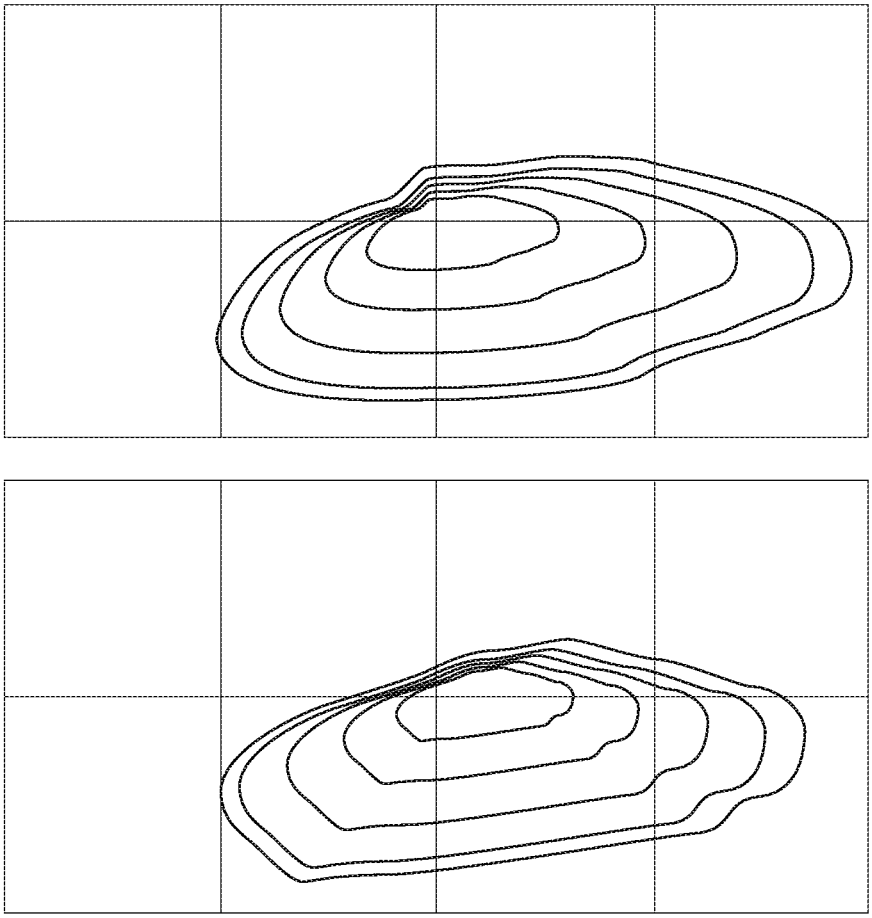
FIG. 12 shows light distributions generated with a segment of the reflector of the light module from FIG. 8.

Here, in the upper projection, FIG. 12 shows a light pattern generated with an untrimmed reflector, whereas the lower projection in FIG. 12 shows the light pattern with a trimming of the reflector in the vicinity of those reflector locations which correspond to filament projections at the envelope curve of the caustic, as described on the basis of FIGS. 10 and 11. The shape of the reflector 22 is given by the trimming.

Due to the trimming, the light-dark boundary becomes more apparent, in particular a better straight course of the inclined light-dark boundary is provided, as can be clearly seen in FIG. 12.

With the light module shown by way of example in FIGS. 8 and 9, the total installation depth is approximately 70 mm. With the lens, a diameter of 100 mm has been assumed, wherein the trimming can be very versatile due to the beam path. Very small lens trims (up to minimal magnitudes of 40 mm×30 mm) are possible without having to put up with large efficiency losses. The example in the diagram represents a light exit surface of 65 mm×45 mm.

By use of a multi-row LED as light source with separately connectable LED rows, an implementation of dipped beam and main beam is also possible merely by connection of the LEDs.

A light source displaced away from the lens (that is to say closer to the reflector) is projected higher. By arranging the LED light source in such a way that a row is closer to the reflector, this closer LED row generates an upwardly displaced light distribution, which can meet the legal requirements of a main beam distribution. The rear LED row is thus projected lower in the focus plane of the lens compared with the front row.

The multi-row LED light source can optionally be rotated about an axis that runs through the dipped beam-relevant chips. In this way, the main beam row is defocused selectively, which leads to a more homogeneous appearance and greater main beam height.

Figure 13:
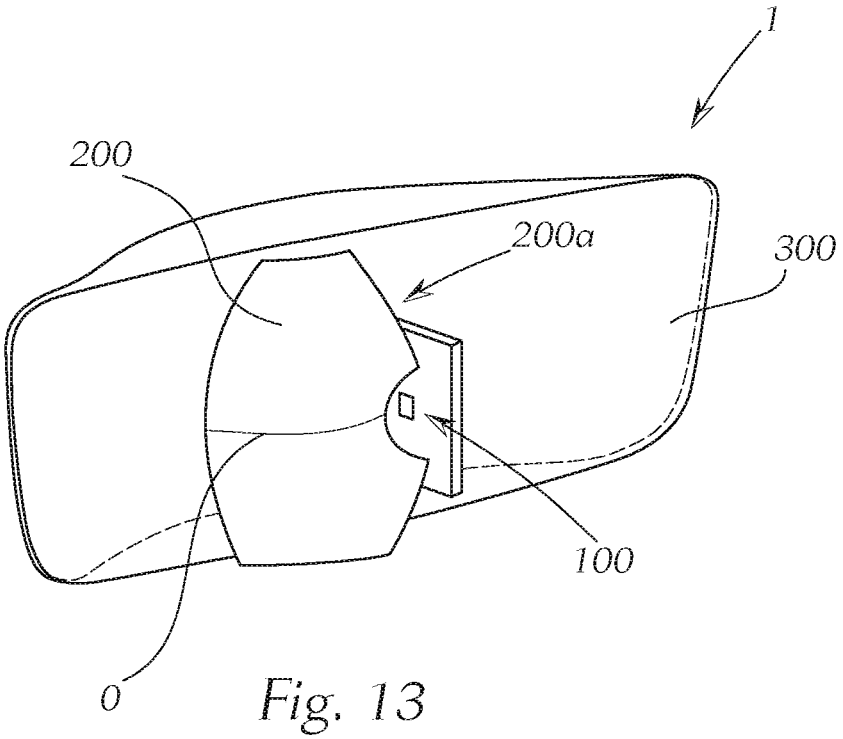
FIG. 13 shows a third variant of a light module according to the invention.

FIG. 13 shows a light module 1 comprising a light source 100, a reflector 200 (with reflecting surface 200*a*) and a lens 300, wherein the reflecting surface 200*a* of the reflector 200 is formed in such a way that light from the light source 100, which is reflected along a defined curve on the reflecting surface 200*a*, is projected in the light pattern as an area with maximum brightness.

Figure 14:
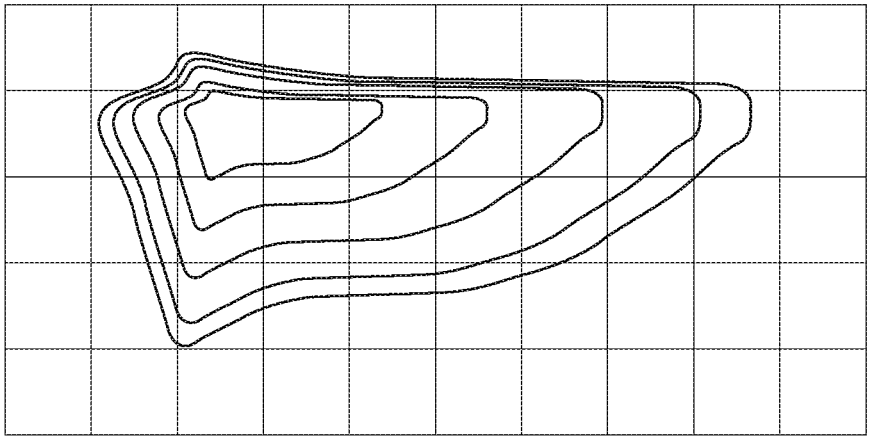
FIG. 14 shows a light distribution generated with a light module from FIG. 13.

The light source 100 comprises one or more light-emitting diodes, which are arranged vertically, of which the light exit surface is thus located in a vertical plane, and this light source 100 illuminates the laterally arranged reflector 200, which generates a substantially horizontal light-dark boundary, as is shown in the light pattern in FIG. 14. The LD boundary is generated in accordance with the invention exclusively by a caustic.

If a primarily hyperbolic reflector having a focal length of approximately 70 mm and an aspherical converging lens having a focal length of approximately 90 mm are used, the overall depth of the light module 1 is approximately 50 mm.

Here, the generation of the light-dark boundary with a reflector is based on the effect of what are known as caustics, and therefore one or more light-dark boundaries formed arbitrarily in principle can be generated without use of stops. The at least one defined curve on the reflecting surface is imaged in the light pattern as a caustic line, that is to say as a line with maximum brightness, and the brightness reduces on one side (for example beneath this line), whereas no light or hardly any light is projected on the other side (that is to say for example above the line).

Figure 15:
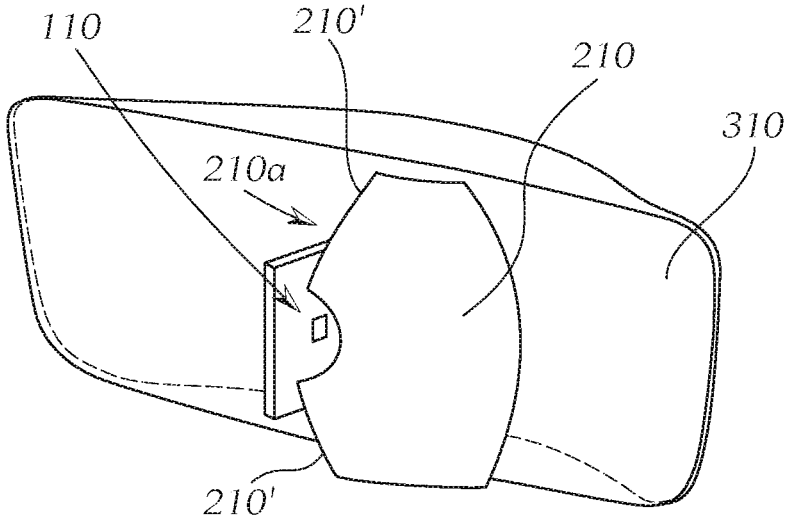
FIG. 15 shows a fourth variant of a light module according to the invention.

FIG. 15 shows a light module comprising a light source 110, in this case again comprising one or more vertically arranged LEDs, and this light source 110 illuminates a laterally arranged reflector 210 comprising a reflective surface 210*a*. The light is projected into an area in front of the light module via a lens 310.

Figure 16:
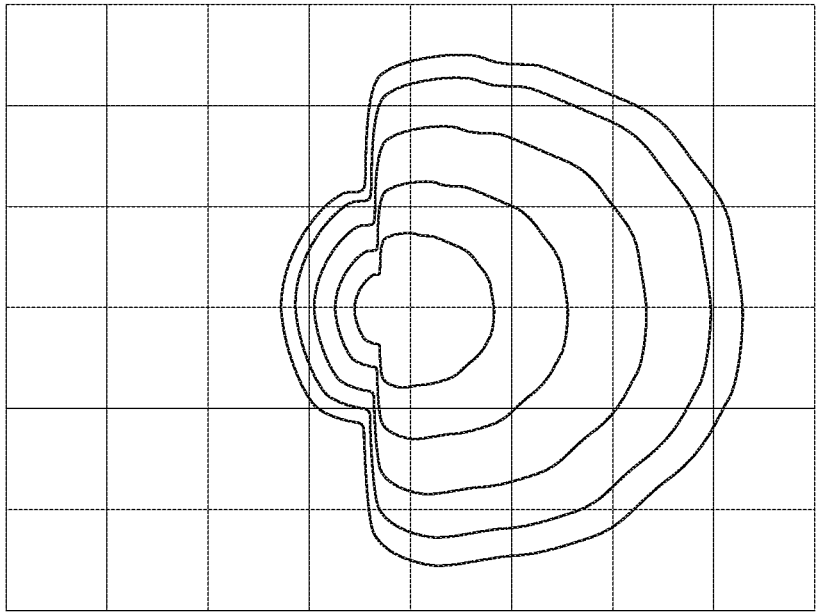
FIG. 16 shows a light distribution generated with a light module from FIG. 14, FIG. 17 schematically shows the beam course with a reflector for generating a caustic.

With this light module, a semi-circular light distribution with pronounced maximum is generated—see FIG. 16. The superimposition with a mirror-inverted light distribution can be used to produce a main beam. The substantially vertical light-dark boundary (see FIG. 16) is generated via the edge 210' of the reflector 210.

In accordance with the invention, a primarily hyperbolic reflector for example having a focal length of approximately 70 mm is used, and in this example an aspherical converging lens having a focal length of approximately 90 mm is also used. The overall depth of the light module is approximately 50 mm.

Lastly, the effect of the caustics, as has already been described briefly in the case of a partial reflector according to FIGS. 8 and 9 on the basis of the FIGS. 10-12 and as is also used with a light module according to FIG. 13, is to be described in greater detail on the basis of FIGS. 17-20.

Figure 17:
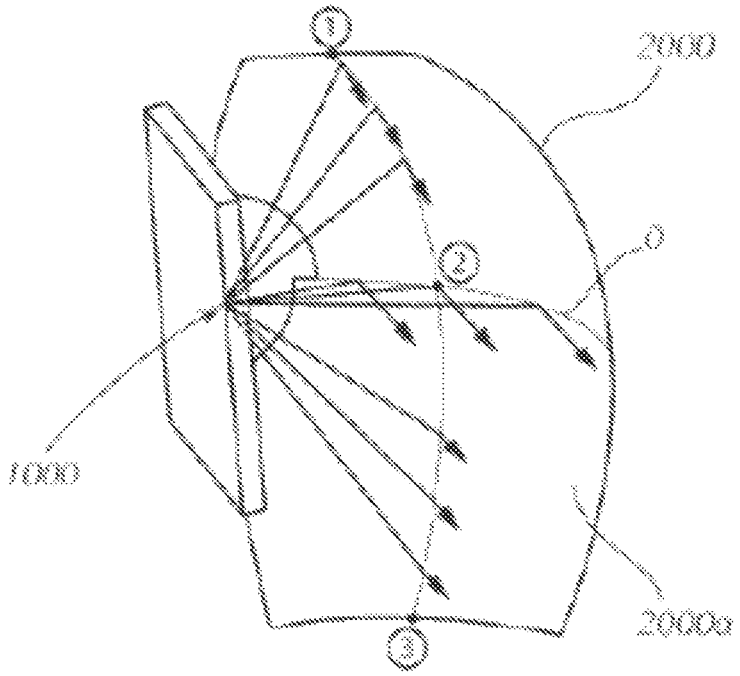

As an example, FIG. 17 shows a laterally arranged reflector 2000, of which the reflecting surface 2000*a* is illuminated by a light source 1000. The reflecting surface 2000*a* of the reflector 2000 is formed in accordance with the invention in such a way that light from the light source 1000, which is reflected along the defined curve O on the reflecting surface 2000*a*, is projected in the light pattern as an area with maximum brightness.

Figure 18:
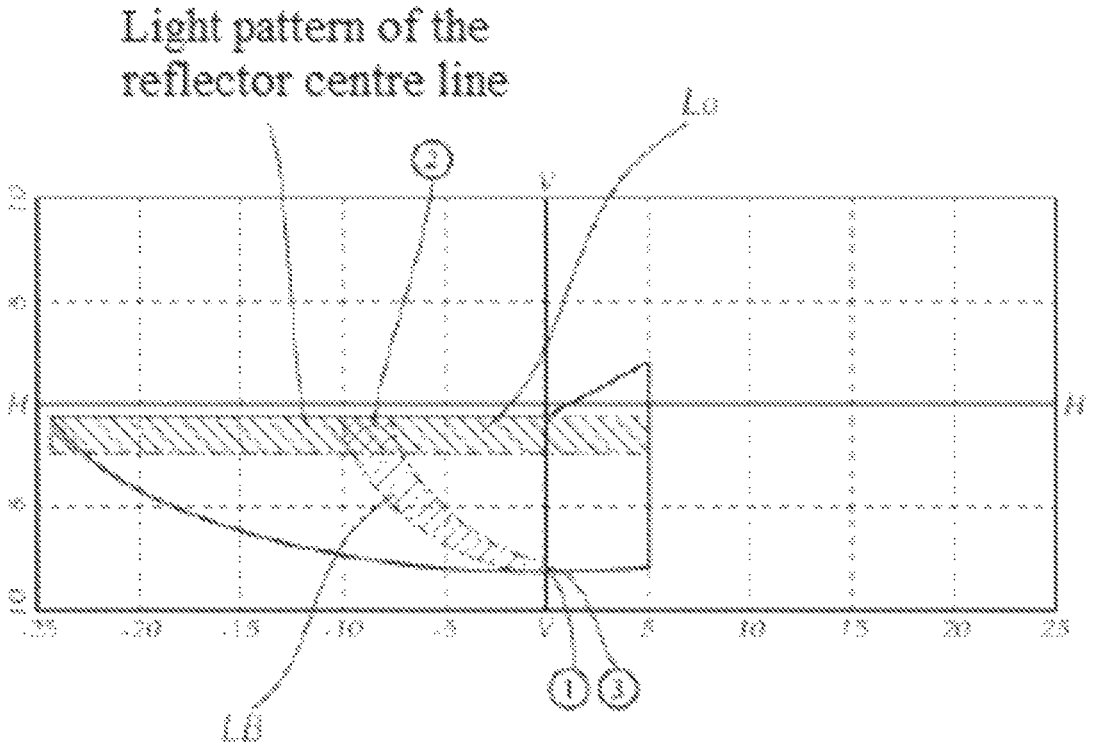
FIG. 18 shows areas in the light pattern corresponding to the beam courses from FIG. 17.
Figure 19:
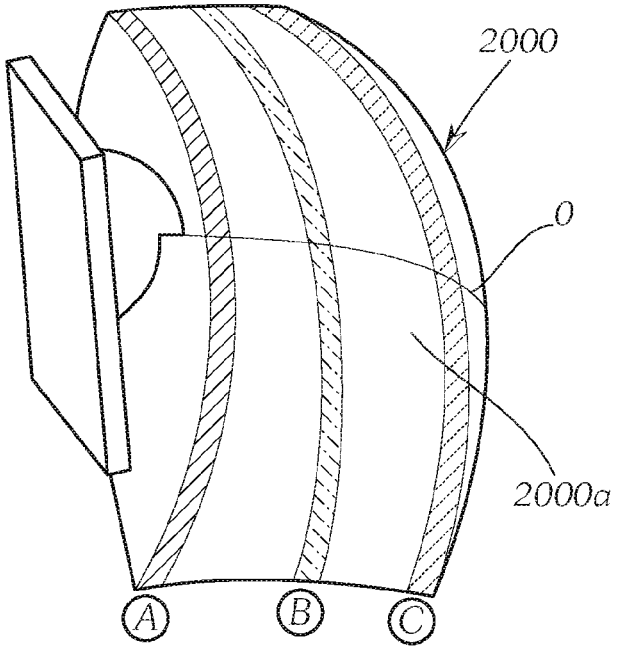
FIG. 19 shows an illustration of specific areas on a reflector according to FIG. 17.
Figure 20:
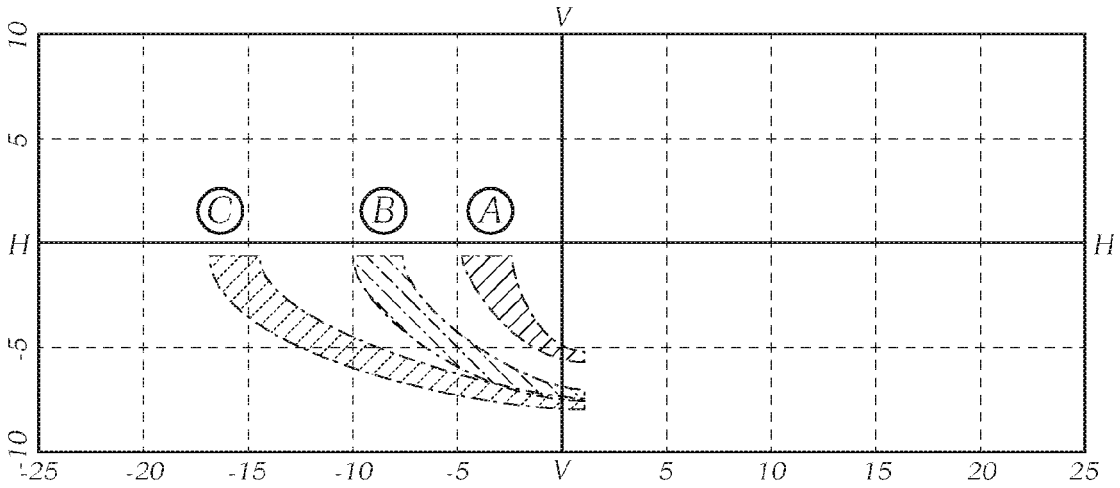
FIG. 20 shows areas in the light pattern corresponding to the specific areas on the reflector.

In the light pattern illustrated in FIG. 18, light from an area around the line O in FIG. 17 illuminates an area at and beneath the horizontal light-dark boundary (see the horizontal hatched area LO in FIG. 18). In this example, the line O runs substantially horizontally. Light originating from the point 2 on the surface 2000*a* approximately illuminates the area in the light pattern denoted by "2".

Light from both sides of the defined curve O on the reflecting surface 2000*a*, that is to say in the shown example light from above and beneath the curve O, is projected in the light pattern on a side of the area with maximum brightness, specifically beneath this area and adjacently thereto.

With a substantially horizontal light-dark boundary (caustic line) as is shown in FIG. 18, the light from both reflector areas is accordingly projected beneath the caustic line and generates the light distribution below the LD line.

There, light from the upper half is reflected downwardly more strongly than light from the lower half. With a movement from an upper point "1" on the reflecting surface 2000*a* via point "2" to point "3", the curved area LB running from top to bottom is thus produced in the light pattern by light beams from an area around this curve running from "1" to "3". Light beams from the point "1" and "3" meet at the lowermost point.

FIG. 19 again shows the reflector 2000 with the reflecting surface 2000*a*. Three different vertically running segments "A", "B", "C" are illustrated and generate the three areas "A", "B", "C" in the light pattern in FIG. 20. Light from the area around the line O is projected at the light-dark boundary in each case, and light from above and below the line O is projected beneath the light-dark boundary. By means of suitable segmentation and appropriate configuration of the individual segments, which preferably adjoin one another continuously, a large degree of freedom is provided with respect to the generation of a desired light pattern with light-dark boundary.

The invention claimed is:

1. A light module (1) for a motor vehicle, comprising:

at least one light source (1, 10, 11, 100, 110);

at least one reflector (2, 20, 21, 200, 210, 2000);

at least one lens (3, 30, 31, 300, 310);

wherein light emitted by the light source (1, 10, 11, 100, 110) is formed into a light distribution by a reflecting surface (2*a*, 20*a*, 21*a*, 22*a*, 200*a*, 210*a*, 2000*a*) of the at least one reflector (2, 20, 21, 200, 210, 2000) and, when the light module (1) is fitted in a vehicle, is projected via the at least one lens (3, 30, 31, 300, 310) into an area in front of the vehicle, wherein the reflecting surface (2*a*, 20*a*, 21*a*, 22*a*, 200*a*, 210*a*, 2000*a*) of the at least one reflector (2, 20, 21, 200, 210, 2000) is formed in such a way that a first focal point (F1) of the reflector (2, 20, 21, 200, 210, 2000) is located between the reflecting surface (2*a*, 20*a*, 21*a*, 22*a*, 200*a*, 210*a*, 2000*a*) and the at least one lens (3, 30, 31, 300, 310) and a second focal point (F2) is located on the side of the reflector (2, 20, 21, 200, 210, 2000) facing away from the lens (3, 30, 31, 300, 310), and wherein the reflecting surface (2*a*, 20*a*, 21*a*, 22*a*, 200*a*, 210*a*, 2000*a*) of the reflector (2, 20, 21, 200, 210, 2000) is designed in such a way that the light pattern generated comprises at least one light-dark line.

2. The light module according to claim 1, wherein in order to form the at least one light-dark line in the light pattern, the reflector (20, 21) is formed substantially as a reflector partial shell, wherein light from an area of a delimiting edge (20', 21') of the reflector partial shell forms the light distribution at the light-dark line in the light pattern.

3. The light module according to claim 2, wherein the reflector partial shell (20, 21) is downwardly open in the fitted position of the light module.

4. The light module according to claim 2, wherein the delimiting edge (20', 21') of the reflector partial shell (20, 21) runs substantially above a plane in which the at least one light source (10, 11) is located.

5. The light module according to claim 2, wherein the delimiting edge (20', 21') is curved toward the front, upwardly toward the front reflector opening.

6. The light module according to claim 1, wherein the at least one light source has an elongate configuration, and the light source is arranged relative to the reflector in such a way that, in the light pattern, the filament images generated by the reflecting surface of the reflector are located substantially parallel to the light-dark boundary in the light pattern.

7. The light module according to claim 1, wherein the at least one light source has a planar light exit surface.

8. The light module according to claim 1, wherein the light-emitting surface of the at least one light source is substantially planar, wherein the delimiting edge of the reflector forming the light-dark boundary is arranged in an area in which the light-emitting surface of the at least one light source is perspectively shortened.

9. The light module according to claim 1, wherein the reflecting surface (22*a*, 200*a*, 210*a*, 2000*a*) of the reflector (21, 200, 210, 2000) is designed in such a way that light from the at least one light source (11, 100, 110) reflected along at least one defined curve (O) on the reflecting surface (22*a*, 200*a*, 210*a*, 2000*a*) is projected in the light pattern as an area with maximum brightness.

10. The light module according to claim 9, wherein the reflecting surface (22*a*, 200*a*, 210*a*, 2000*a*) of the reflector (21, 200, 210, 2000) is designed in such a way that light from both sides of the at least one defined curve (O) on the reflecting surface (22*a*, 200*a*, 210*a*, 2000*a*) is projected in the light pattern on a side of the area with maximum brightness, adjacently to said area.

11. The light module according to claim 9, wherein starting from a reflector (200, 210, 2000), which generates a defined light distribution with defined brightness distribution, this reflector (200, 210, 2000) is trimmed substantially parallel to the defined curve on the reflecting surface (200*a*, 210*a*, 2000*a*), which is projected in the light pattern as an area with maximum brightness, on at least one side of the defined curve.

12. The light module according to claim 9, wherein starting from a reflector (200, 210, 2000), which generates a defined light distribution with defined brightness distribution, this reflector (200, 210, 2000) is trimmed substantially normal to the defined curve on the reflecting surface (200*a*, 210*a*, 2000*a*), which is projected in the light pattern as an area with maximum brightness.

13. The light module according to claim 1, wherein the at least one lens (3, 30, 31, 300, 310) is formed as an achromatic lens.

14. A vehicle headlight comprising at least one light module (1) according to claim 1.

15. The light module according to claim 2, wherein the reflector partial shell is a reflector half shell.

* * * * *